US006328046B2

(12) United States Patent
Doreste

(10) Patent No.: US 6,328,046 B2
(45) **Date of Patent: *Dec. 11, 2001**

(54) SELF-ANCHORING BEACH UMBRELLA

(76) Inventor: Eric K. Doreste, 23 Iowa Rd., Great Neck, NY (US) 11020

( * ) Notice: Subject to any disclaimer, the term of this patent is extended or adjusted under 35 U.S.C. 154(b) by 0 days.

This patent is subject to a terminal disclaimer.

(21) Appl. No.: 09/729,325

(22) Filed: Dec. 4, 2000

Related U.S. Application Data

(63) Continuation-in-part of application No. 09/513,676, filed on Feb. 25, 2000, now Pat. No. 6,267,127.

(51) Int. Cl.[7] ..... A45B 23/00

(52) U.S. Cl. ..... 135/15.1; 52/165; 248/156; 248/530

(58) Field of Search ..... 52/165, 726.1; 135/15.1, 34.2, 76; 248/530, 156

(56) References Cited

U.S. PATENT DOCUMENTS

| | | | | |
|---|---|---|---|---|
| D. 371,901 | | 7/1996 | Perls . | |
| D. 394,544 | | 5/1998 | Tropiano . | |
| D. 402,803 | | 12/1998 | Goldberg et al. . | |
| 1,943,018 | * | 1/1934 | Hench | 52/165 |
| 2,475,041 | * | 7/1949 | Mattson | 248/156 X |
| 2,759,486 | | 8/1956 | Pesaturo . | |
| 3,823,785 | * | 7/1974 | Toliver | 248/156 X |
| 4,023,582 | * | 5/1977 | Buzzella et al. | 135/15.1 |
| 4,459,787 | * | 7/1984 | Wilcox | 135/15.1 |
| 4,649,678 | * | 3/1987 | Lamson | 52/165 |
| 5,152,495 | * | 10/1992 | Jacinto et al. | 248/530 X |
| 5,165,663 | * | 11/1992 | Wells | 52/165 X |
| 5,427,346 | * | 6/1995 | Urgola | 135/16 X |
| 5,457,918 | | 10/1995 | Plourde . | |
| 5,518,218 | * | 5/1996 | Leonard | 248/530 |
| 5,535,978 | | 7/1996 | Rodriguez et al. . | |
| 5,636,649 | * | 6/1997 | Horvath | 135/16 |
| 5,636,944 | | 6/1997 | Buttimore . | |
| 5,662,304 | | 9/1997 | McDaniel . | |
| 5,692,720 | | 12/1997 | Griggs . | |
| 5,871,025 | * | 2/1999 | Richter | 135/65 |
| 5,884,874 | * | 3/1999 | Speece et al. | 248/516 |
| 5,906,077 | | 5/1999 | Andiarena . | |
| 6,018,926 | * | 2/2000 | Chen-Chao | 52/736.1 |

* cited by examiner

*Primary Examiner*—Beth A. Stephan
*Assistant Examiner*—Brian E. Glessner
(74) *Attorney, Agent, or Firm*—Sherman D. Pernia

(57) ABSTRACT

A self-anchoring beach umbrella having an umbrella canopy and an umbrella pole. The umbrella pole having an upper member for supporting the canopy and a lower member for self-anchoring the umbrella into a ground surface. The upper member being an elongated tubular sleeve having a first end communicating with and supporting the umbrella canopy, an axial lumen formed within the elongated tubular sleeve, and a second end for receiving a pole standard into the axial lumen. The lower member being a pole standard having a length, a first end formed for insertion into the axial lumen of the elongated tubular sleeve, and a second end formed for anchoring into the ground surface. A hammer is fixed to the elongated tubular sleeve, the hammer included for transmitting an axial force applied to the elongated tubular sleeve onto an anvil. The anvil fixed to the pole standard for receiving the axial force from the hammer and transmitting it to the pole standard to anchor the pole standard into the ground surface. An optional tilt mechanism for angling the canopy relative to the umbrella pole is included in the present beach umbrella. Also, an optional handle is provided at the top of the canopy of the umbrella. Additionally, the umbrella pole can be used without the canopy to display a flag indicating the user location on a crowded beach, or in pairs to mount a net such as for volley ball.

16 Claims, 5 Drawing Sheets

SELF-ANCHORING BEACH UMBRELLA

The present application is a C-I-P of prior filed U.S. patent application, Ser. No. 09/513,676 filed Feb. 25, 2000, now U.S. Pat. No. 6,627,227 to which the present application is a regular U.S. national application.

Inventor: Eric K Doreste

FIELD OF THE INVENTION

The present invention is in the field of umbrellas for use at the beach or other locations where it is desired to provide shade or protection from the weather. More specifically, the present invention is directed to a beach umbrella that additionally provides a means for anchoring the pole of the umbrella into a beach or ground surface.

BACKGROUND OF THE INVENTION

The harmful and damaging effects of the sun's ultraviolet rays have been well documented. These effects can be intensified at the beach. Umbrellas are often used to provide protection from both weather and the damaging ultraviolet rays of the sun, especially at the beach. These umbrellas typically include an umbrella canopy and an umbrella pole. In some instances, it is desired to anchor the umbrella pole into a ground or beach surface. In these instances, the canopy is attached to the top end of the umbrella pole, and the other end of the pole is typically anchored into a ground surface. Anchoring an umbrella's pole into a ground surface eliminates the need for an individual to hold the umbrella, and allows freedom of movement in and out of the area where the umbrella provides its protection. However, anchoring traditional umbrellas can sometimes be difficult or cumbersome, especially if the ground surface into which the umbrella is to be anchored is hard.

Various attempts have been made to provide devices for anchoring umbrellas into a ground surface. Anchoring devices have been suggested that are designed to be screwed into a ground surface on one end, and another end in which to secure the bottom end of an umbrella. Such devices can be found in Andiarena, U.S. Pat. No. 5,906,077, Plourde, U.S. Pat. No. 5,457,918, Rodriguez et al., U.S. Pat. No. 5,535,978, Buttimore, U.S. Pat. No. 5,636,944, McDaniel, U.S. Pat. No. 5,662,304, Goldberg et al., U.S. Pat. No. D402,803, Perls, U.S. Pat. No. D371,901, and Tropiano, U.S. Pat. No. D394,544. A disadvantage of having a separate anchor into which an umbrella pole is inserted is that it is necessary to transport both the umbrella and the separate anchoring device to the point of use. Additionally, the orifice in the anchor into which the umbrella pole is to be inserted can become clogged with sand or such in the installation process.

Another beach umbrella anchoring means requires attaching the umbrella pole to a bucket-like anchor device and burying the anchor in the sand (Buttimore, U.S. Pat. No. 5,636,944). However, the '944 device is also a component separate from the umbrella itself. Another device suggested for anchoring umbrellas into a ground surface has provided an umbrella comprising an umbrella pole and one or more umbrella canopies, with an attached handle for forcing the umbrella standard into the ground surface. Griggs, U.S. Pat. No. 5,692,720. However, to anchor the umbrella disclosed in Griggs '720, one is taught to urge the umbrella pole into the ground surface by rotating while pushing downward on the pole, and depends on the strength of the user to accomplish its anchoring feature.

A further umbrella device is disclosed by Pesaturo, U.S. Pat. No. 2,759,486. The Pesaturo device includes a slide hammer mechanism. In the Pesaturo device, two anvils are affixed to the umbrella pole and a hammer is slideably disposed between them. Impacting the hammer upon either anvil allows the user to drive the umbrella pole into the ground surface, or upwardly force the umbrella standard from the ground surface. Pesaturo '486 however requires the addition of three heavy pieces of metal to the umbrella pole. This makes the umbrella appreciably heavier and requires the user to devote more resources to carrying an umbrella with a hammer and two anvils in addition to other items that would normally be transported on an outing where such an umbrella is used.

It would be beneficial to have available a self-anchoring beach umbrella wherein the umbrella incorporates a means for facilitating the anchoring of the umbrella without requiring separate hardware or additional mass to accomplish.

SUMMARY OF THE INVENTION

The present invention solves a number of the problems inherent in the prior art by providing a self-anchoring beach umbrella comprising an umbrella canopy and an umbrella pole. The canopy is typical of such umbrella elements as are presently known in the art. The umbrella pole has an upper member for supporting the canopy and a lower member for self-anchoring the umbrella into a ground surface. The upper member is an elongated tubular sleeve having a first upper end communicating with and supporting the umbrella canopy section of the umbrella. The top end of the umbrella canopy optionally may terminate in an handle for facilitating the transport, use and storage of the present beach umbrella. The upper member or tubular sleeve also contains a lumen disposed along the axis within the elongated tubular sleeve, and has a second lower end for receiving a pole standard into the axial lumen. The lower member is a pole standard with its first upper end formed for insertion into the axial lumen of the elongated tubular sleeve. The pole standard has a second or anchor end formed for anchoring into the ground surface. A hammer is fixed to the elongated tubular sleeve for transmitting an axial force applied to the elongated tubular sleeve onto an anvil. The anvil is fixed to the pole standard for receiving the axial force from the hammer and transmitting the force to the pole standard to anchor the pole standard into the ground surface.

The axial lumen is formed inside of the tubular sleeve to coaxially and slideably receive the first upper end of the pole standard. The hammer and the anvil, respectively, are capable of transmitting and receiving a downward axial force of sufficient magnitude to drive the pole standard into the ground surface and provide an anchoring effect. The impact force of the hammer is developed by the mass of the upper member, either alone or in combination with the mass of the attached canopy.

The hammer can be formed inside the tubular sleeve and fixed to a wall of the lumen far from the second end of the sleeve with the anvil fixed at the first end of the pole standard. The anvil is slideably received into the lumen of the tubular sleeve and the tubular sleeve is slid down the length of the pole standard to cause the hammer to impact the anvil.

In an alternative embodiment the hammer is fixed at the second end of the tubular sleeve and configured to allow insertion of the first end of the pole standard into the lumen of the tubular sleeve. In this case the hammer may be configured as an annulus. Further, in this embodiment, the anvil is a collar fixed on the outer surface of the pole standard between the first and second ends of the pole standard, and disposed to receive the downward axial force from the hammer. Other alternative embodiments of the hammer and anvil are practicable by one of ordinary skill in the art.

Anchoring the self-anchoring umbrella into a ground surface involves positioning the second anchor end of the pole standard at the ground surface, then inserting the tubular sleeve coaxially over the pole standard to receive the pole standard into the lumen of the tubular sleeve. A downward axial force is then applied on the tubular sleeve to slideably receive the pole standard into the lumen of the tubular sleeve and to cause the hammer to impact the anvil. Impacting the hammer onto the anvil initiates penetration of the ground surface by the pole standard. Finally, reapplying the downward axial force on the tubular sleeve to repeatedly impact the hammer upon the anvil will cause the pole standard to be driven into the ground surface.

Once the standard is driven into the ground sufficiently to anchor the umbrella pole, the tubular sleeve is left in place and the umbrella canopy can be positioned and deployed. Optionally, a slide/sleeve lock can be included on the umbrella pole to allow the tubular sleeve to be set at different positions along the length of the standard. This feature enables the user to adjust the length of the umbrella pole, and hence, vary the height of the canopy from the ground surface. Additionally, because the tubular sleeve is on the outside and above the anchor standard, sand and other debris is less likely to enter the lumen of the sleeve and cause excess wear or binding of the slide action of the sleeve.

Optionally, the umbrella of the present invention includes a tilt mechanism that allows the canopy, when raised or extended, to be offset at an angle from the rest of the umbrella pole. Typically, the tilt mechanism is incorporated into the present umbrella pole between the tubular sleeve aid the canopy of the umbrella. Mechanisms for raising or extending an umbrella canopy such as are practicable in the present invention are known in the art, and are readily adaptable by the ordinary skilled artisan for use in the present invention.

Also, the present device includes one or more extension sections that can be inserted in series into the umbrella pole to adjust the length of the pole. It is also intended that the user can dismount the umbrella canopy from the umbrella pole and use the pole for other related purposes. For example, as a flag pole on which a pennant may be displayed so that the user's location may be more easily found on a crowded beach, an important benefit when at the beach with children. Additionally, the present invention without the umbrella canopy attached may be used as a tether ball pole. Alternatively, two umbrella poles without canopies may be used to mount a net between them, such as for volley ball or badminton.

Other and further features and advantages will be apparent from the following description of presently preferred embodiments of the invention, given for the purpose of disclosure when taken in conjunction with the accompanying drawings. For example, the present invention without the umbrella canopy is readily adaptable as a self-anchoring pole for a volley ball, badmitton or similar net game.

BRIEF DESCRIPTION OF THE DRAWINGS

FIG. 9C is a perspective view of an insert section that incorporates a pinch or squeeze type clamp mechanism to act as a slide lock for adjusting the length of the umbrella pole. Additionally, the insert section shows a detent eye-pin installed at its upper end to serve as an attachment point for a flag, tether ball, net or the like.

DETAILED DESCRIPTION OF THE INVENTION

Figure 1:
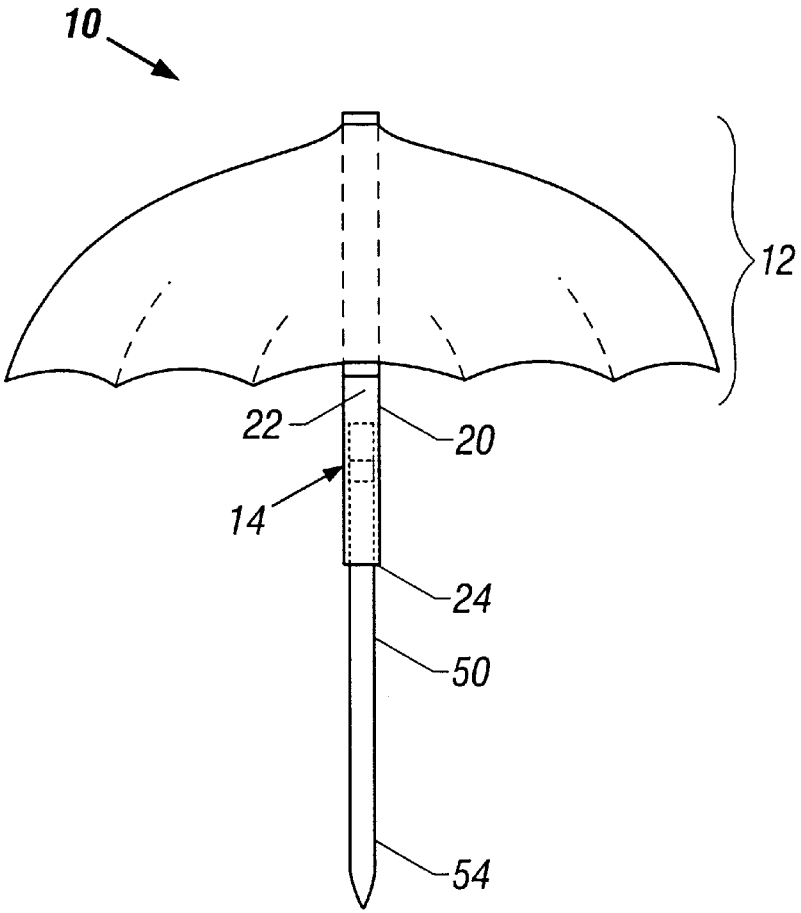
FIG. 1 is a schematic view of a typical self-anchoring beach umbrella of the present invention.

Referring now to the drawings, the details of preferred embodiments of the present invention are graphically and schematically illustrated. Like elements in the drawings will be represented by like numbers. FIG. 1 represents a typical embodiment of a self-anchoring beach umbrella 10 according to the present invention. The umbrella 10 includes an umbrella canopy 12 supported by an umbrella pole 14. The umbrella canopy 12 is typical of such canopies as are known in the art. The canopy 12 can include the elements and features that are typically found on such canopies, including opening and closing means, tilting means, and similar umbrella canopy features. Such features and variations are known to and readily practicable by the ordinary skilled artisan. The umbrella pole 14 is comprised of an upper member 20 and a lower member 50. The umbrella canopy 12 is supported by the upper member 20 by a connection (not shown) to the upper member 20 at the upper member's first or canopy end 22. The connection to the canopy 12 to the canopy end 22 of the upper member 20 may be fixed, so that the canopy 12 and the upper member 20 are substantially integral with each other. Alternatively, the connection may be separable, so that the canopy 12 and the upper member 20 can be attached or separate as desired. The top end 80 of the canopy 12 may terminate in a handle 82 (see FIG. 7A).

The upper member 20 of the umbrella pole 14 is configured as an elongated tubular sleeve. The cross-section of the tubular sleeve 20 may be square, oval, oblong or shaped as practicable by one of ordinary skill in the art. In the preferred embodiment, the tubular sleeve 20 has a circular cross-section. The interior of the tubular sleeve defines an axial lumen 26.

Figure 3:
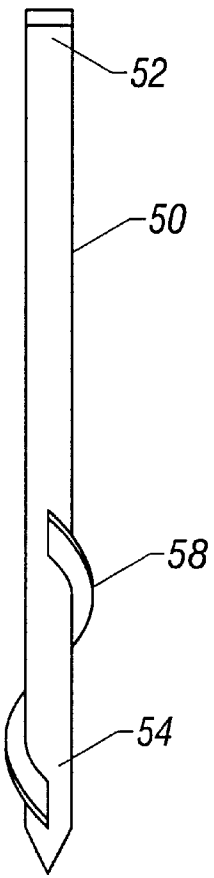
FIG. 3 is a side view of a lower member or standard of the present pole showing an anchor vane or screw associated with the pole standard's anchor end.
Figure 2:
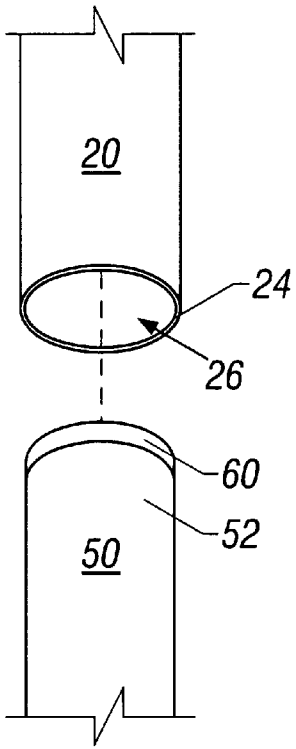
FIG. 2 is a perspective drawing of a section of the present pole showing the insertion of the lower member or pole standard into the lumen of the upper member or tubular sleeve of the pole.

As shown in FIG. 2, the lower member (pole standard) 50 of the umbrella pole 14 has a cross-section complementary to that of the upper member tubular sleeve 20 that allows it to be closely received into the internal space or lumen 26 of the upper member tubular sleeve 20. As shown in FIG. 3, the lower member or pole standard 50 has a pole standard first end 52 and a pole standard anchor end 54. The pole standard first end 52 is formed to be axially inserted into the lumen 26 of the tubular sleeve 20, whereas the pole standard anchor end 54 is shaped to facilitate ground surface penetration. In FIG. 3, the anchor end 54 is illustrated as pointed as a preferred embodiment. However, other configurations for the anchor end 54 are known and are practicable by the ordinary skilled artisan. The pole standard anchor end 54 may be modified to better facilitate its penetration of specific types of ground surfaces, or to accomplish a specific result. For example, as shown in FIG. 3, an otherwise plain pointed pole standard 50 is modified to include an anchor vane 58 to help prevent the pole standard from rotating once it is set into a ground surface. Although, only a single anchor vane 58 is shown, multiple such vanes may be practiced on a pole standard 50 anchor end 54. Ground surfaces being penetrated typically are sand, clay, soil, gravel and similar ground surfaces where it is desired to utilize the self-anchoring beach umbrella 10 of the present invention.

FIGS. 4A to 4E are cross-sectional views of a pole standard 50 received into a tubular sleeve 20. The various illustrations show different preferred means of accomplishing the hammer and anvil elements of the present invention. Using FIG. 4A as exemplary of these preferred embodiments, a hammer 40 is fixed within the lumen 26 of the tubular sleeve 20. The hammer 50 provides for transmitting an axial force (see FIG. 4A, arrow) applied to the tubular sleeve 20 onto the anvil 60 upon impact. The force of the impact is transmitted by the anvil 60 to the pole standard 50 by virtue of the anvil's fixed relationship to the pole standard 50. The force transmitted to the pole standard 50 acts to drive the pole standard anchor end 54 into the ground surface. The axial force transmitted by the hammer 40 is generated by the combined masses of the tubular sleeve 20 and hammer 40 as they are moved (at some rate, through some distance) to impact the anvil 60. If the umbrella canopy 12 is attached to the tubular sleeve 20, the combined mass is increased, and the potential axial force transmitted by the hammer 40 may be increased for the same movement.

Figures 4A, 4B, 4C, 4D, 4E:
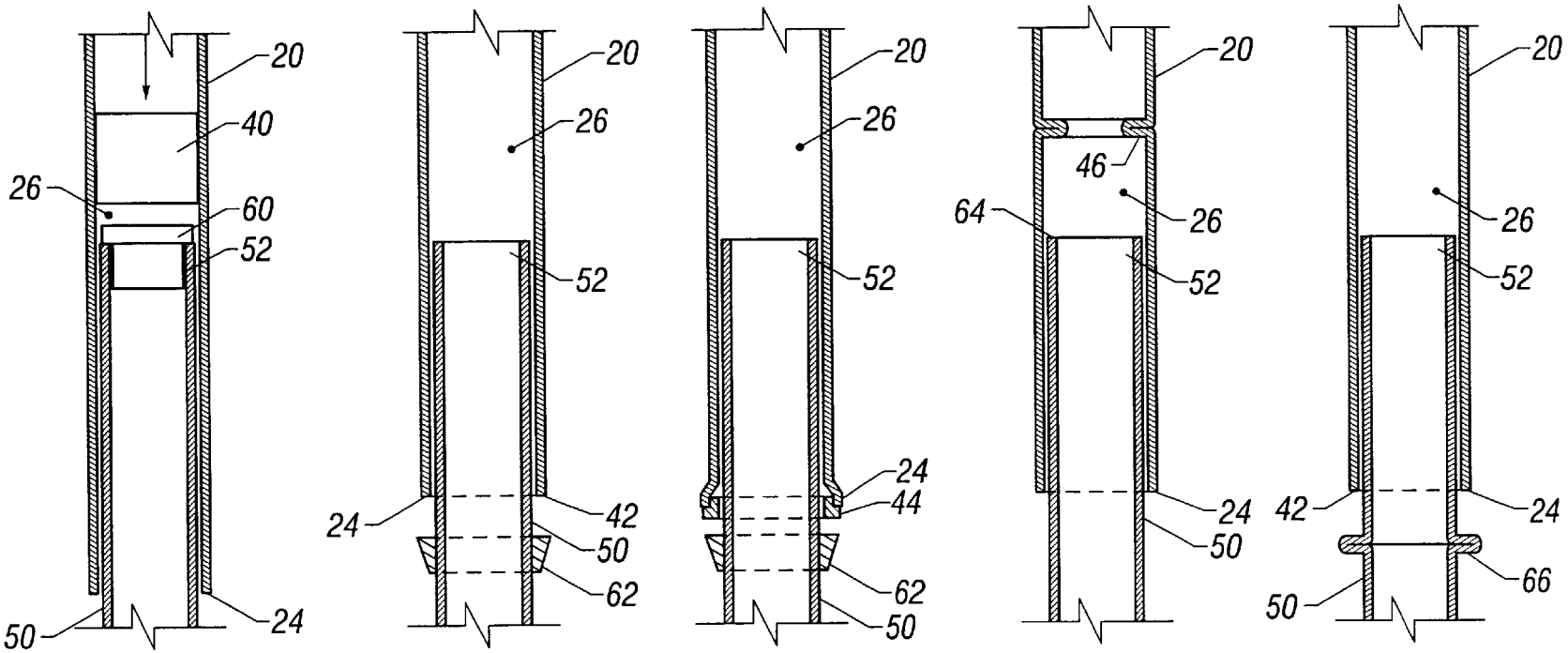
FIGS. 4A to 4E are cross-sectional views of the present pole showing the standard (lower member) received into the tubular sleeve (upper member), and illustrating various embodiments of the hammer and anvil elements of the present invention.

In FIG. 4B, the hammer 42 is comprised of the rim of the tubular sleeve's 20 second end 24. The anvil 62 is a collar fixed to an outer surface of the pole standard 50 at a position distal from the pole standard upper end 52. Again in this embodiment, axial force is generated as described above, and when the tubular sleeve 20 is axially slid downward, the hammer 42 impacts against the anvil 62 and the axial force is transmitted to the pole standard 50. FIGS. 4C to 4E similarly illustrate different preferred means accomplishing the hammer and anvil elements of the present invention and the generation and transmission of an axial force from the tubular sleeve 20 to the pole standard 50. In FIG. 4C the tubular sleeve open end 24 is reinforced as might be necessary if a relatively large force must be transmitted by the hammer 44. In FIG. 4D the hammer 46 and in FIG. 4E the anvil 66 are accomplished by crimping the material of the tubular sleeve 20 or the pole standard 50 either internally or externally, respectively. Either of these configurations might be beneficial where the amount of force to be transmitted by a hammer is relatively small, such as when the ground surface to be penetrated is soft.

In operation, when the self-anchoring umbrella 10 is desired to be used, the pole standard anchor end 54 is positioned for anchoring at the ground surface. With the tubular sleeve 20 coaxially inserted over the pole standard 50, so that the pole standard is fully inserted into the lumen 26 of the tubular sleeve 20, the tubular sleeve 20 is raised an appropriate distance, and then urged back down over pole standard 50. The downward force applied to the tubular sleeve 20 causes the pole standard first end 52 to slideably reinsert into the lumen 26 of the tubular sleeve 20, and cause the hammer 46 to impact the anvil 66. Accordingly, the force generated by the movement of the tubular sleeve 20 is transmitted via the hammer 46 onto the anvil 66, and ultimately to the pole standard anchor end 54. To anchor the self-anchoring beach umbrella 10 into the ground surface, the axial force applied to the elongated tubular sleeve 20 should be sufficient for the pole standard anchor end 54 to penetrate the ground surface. To complete the anchoring process, the axial force repeatedly is applied to the tubular sleeve 20 so that the pole standard anchor end 54 is driven further into the ground surface to a depth sufficient to support and anchor the self-anchoring beach umbrella 10 in the desired manner. Sufficient anchoring of the self-anchoring beach umbrella 10 involves preventing the umbrella from tipping and the ability of the self-anchoring beach umbrella 10 to withstand expected wind gusts without becoming dislodged from the ground surface.

Figure 5B:
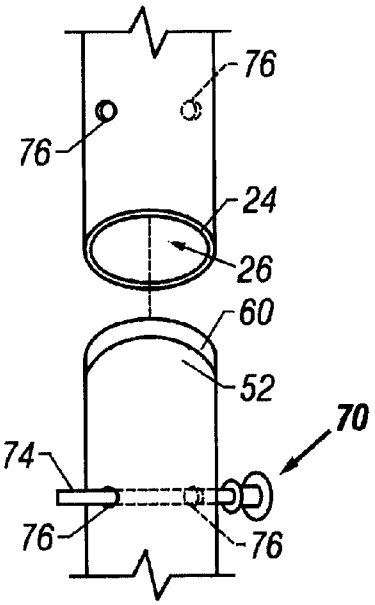
FIG. 5B shows a through pin and hole means serving as a slide lock to adjust the length of the umbrella pole as an alternative to that shown in FIG. 5A.
Figure 5A:
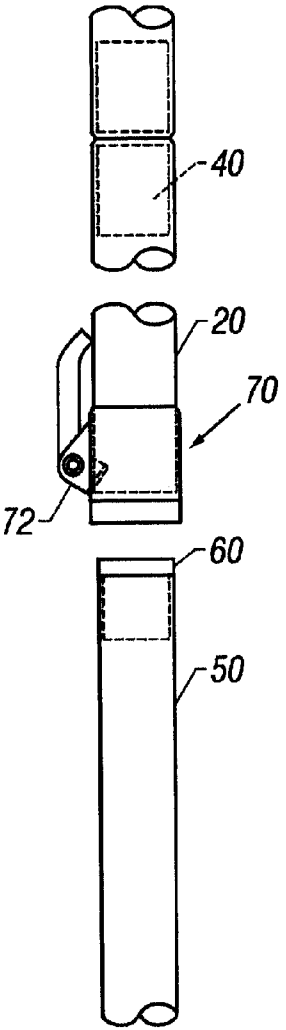
FIG. 5A shows a lever actuated type slide or sleeve lock used to adjust the length of the umbrella pole and the height of the canopy from the ground surface.

Once the standard 50 is driven into the ground sufficiently to anchor the umbrella 10, the tubular sleeve 20 is left in place and the canopy 12 is deployed. As shown in FIGS. 5A & 5B, if it is desirable to be able to adjust the length of the umbrella pole 14, and hence, the height of the canopy 12 from the ground, a slide or sleeve lock 70 may be included on the umbrella pole 14. A sleeve lock 70 can be a lever actuated squeeze clamp 72 such as are known in the art and presently practiced on umbrella poles (see FIG. 5A). Other alternative embodiments of a sleeve lock are known to the ordinary skilled artisan and can be readily adapted for practice in the present invention. For example, a simple detent pin 74 and through hole 76 combination can be practiced on either the standard 50 or the tubular sleeve 20 or both to provide for adjusting the length of the umbrella pole 14. See FIG. 5B.

As is understood in the art, the various hammers and anvils of the present invention should be constructed of material that is capable of withstanding repeated and elevated impact forces. Typically, the axial force would be applied to the elongated tubular sleeve by a person grasping the tubular sleeve 20 or the umbrella canopy 12 (if attached) and raising the tubular sleeve 20 an appropriate distance, and then forcing the tubular sleeve 20 downward. An appropriate distance is a distance high enough to develop sufficient potential energy to drive the pole standard anchor end 54 into the ground surface, yet not so high as to extract the pole standard first end 52 from the lumen 26 of the tubular sleeve 20.

In another embodiment, the present umbrella 10 includes a tilt mechanism 88 that allows the raised or extended canopy 12 to be offset at an angle from the length of the rest of the umbrella pole 14. Preferably, the tilt mechanism 88 is incorporated into the present umbrella pole 14 between the tubular sleeve 20 and the canopy 12 section of the umbrella 10. The tilt mechanism 88 allows the canopy 12 to be tilted at an angle after it is raised and positioned by the user to enhance the utility of the umbrella 10, for example, for providing shade.

Tilt mechanisms 88 for umbrellas are known in the art and are readily adaptable by the skilled artisan for practice in the present invention. FIGS. 6A to 6D are examples of such tilt mechanisms 88 as may be adapted for practice in the present umbrella 10. FIG. 6A is an example of a tilt mechanism 88*a* as is known in the art which allows the canopy 12 to be angled in a plane perpendicular to the pivot pin 94. The tilt mechanism 88*a* is operated by pushing the spring biased release button 92, tilting the canopy 12 to the desired angle and releasing the button 92. The tilt mechanism 88 may be fixed or incorporated into either the canopy 12 or to the tubular sleeve 20 allowing the canopy 12 and sleeve 20 to be separable into two parts. In a preferred embodiment, the tilt mechanism 88 is separable from both the canopy 12 and the tubular sleeve 20. Either of these embodiments allow the canopy to swivel or rotate about the rest of the umbrella pole by having a shoulder 90 of the tilt mechanism 88 disposed to provide a surface against which either the canopy 12 or the tubular sleeve 20 may rotate. Alternatively, the tilt mechanism may be fixed to both the canopy 12 and sleeve 20, connecting them as a single unit. The figures show the tilt mechanism 88 having two male ends that are received into female ends on the canopy 12 and the tubular sleeve 20. One skilled in the art knows how to select and practice other combinations of male and female end features to accomplish the purpose of a rotatable canopy.

Figure 6B:
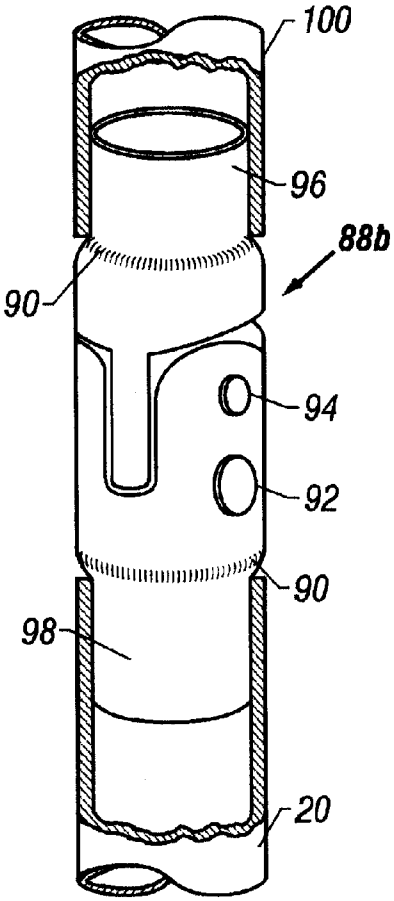
FIGS. 6A to 6D are combination cross-section and perspective drawings showing the relationship of various tilt mechanisms incorporated into the umbrella pole between the tubular sleeve and the canopy sections of the present umbrella.
Figure 6A:
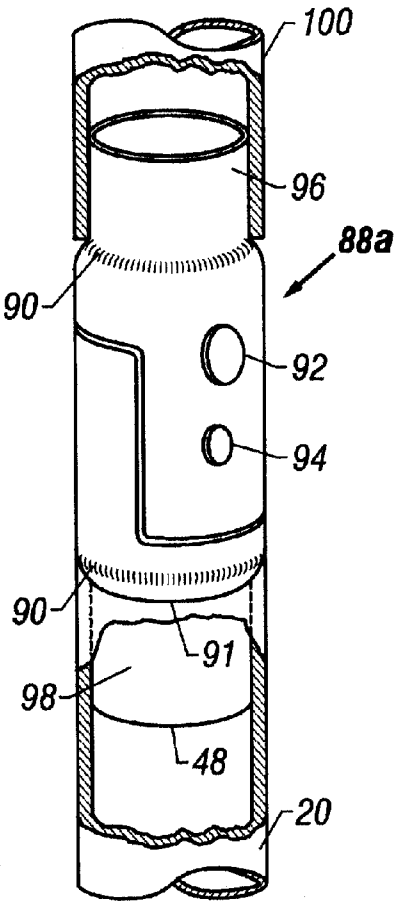
Figure 6D:
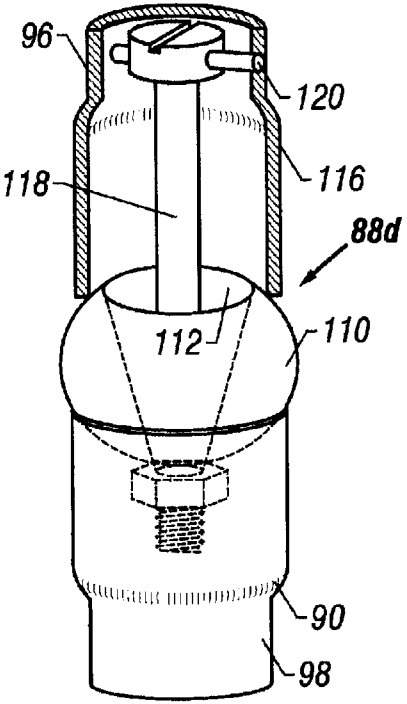
Figure 6C:
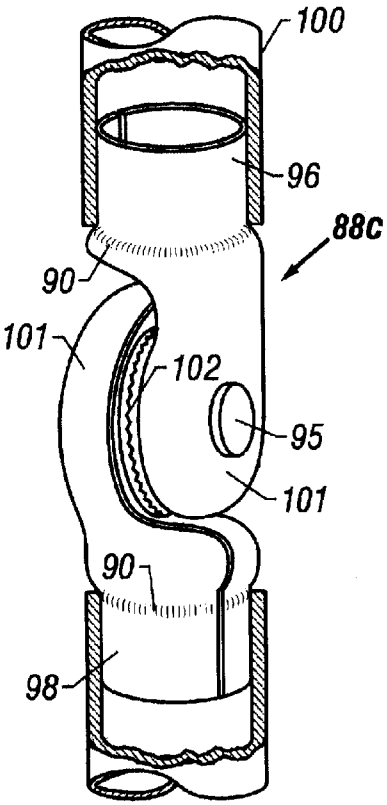

FIGS. 6B to 6D illustrate various means of accomplishing the tilt and swivel processes exemplified in FIG. 6A above. As generally shown in the figures, the tilt mechanism 88 has a tubular upper section 96 and a tubular lower section 98. The tilt lower section 98 inserts into the lumen 26 of the tubular sleeve 20 and the tilt upper section 96 inserts into the lumen of the canopy tube 100 of the canopy 12. FIG. 6B, shows a tilt mechanism 88*b* similar to that of FIG. 6A in operation, but having a slightly different pivot structure, while swiveling in the same manner.

FIG. 6C, shows a tilt mechanism 88*c* having paddle shaped heads 101 which interface with each other at a toothed interface assembly 102. The paddle shaped heads 101 are connected and held together at the toothed interface assembly 102 by a combination spring biased release and pivot pin 95. Pressing the release button 95 removes the bias from the toothed interface assembly 102 allowing them to be rotated relative to each other, thus accomplishing tilting of the canopy 12. Releasing the combination button 95 reapplies the bias to the toothed interface 102 and holds the heads 101 in the selected position.

In FIG. 6D, the tilt mechanism 88*d* comprises a ball and socket asembly. The ball 110 is securely attached to the lower tilt section 98 as shown. The ball 110 has a channel 112 through it which tapers from the top of the tilt ball 110 toward the bottom of the ball 110. The tapered channel 112 may be cone shaped or oblong (as shown in FIG. 6D). Proximate the bottom of the ball 110 and in line with the tapered channel 112 is a threaded receptacle 114, such as a nut. The threaded receptacle 114 is disposed to have some movement from side-to-side, while being prevented from rotating relative to the ball 110. Movably mounted in close contact with the top of the tilt ball 110 is a socket 116. The tilt socket 116 is held in contact with the ball 110 by a threaded fastener 118, such as a bolt. The threaded fastener is fixed from rotating relative to the socket. In the embodiment exemplified in FIG. 6D, the head of the fastener 118 is fixed to the socket 116 by a bolt pin 120. The shaft of the fastener passes out of the socket 116, through the tapered channel 112 and is screwed into the threaded receptacle 114. In use, the socket 116 of the tilt mechanism 88*d* is unscrewed sufficiently to allow the socket 116 to move or slide about the surface of the tilt ball 110, at least to the extent allowable by the tapered channel 112. When the upper section 96 of the tilt mechanism is in a desired position, the socket 116 is screwed down tight to prevent it from moving about the surface of the tilt ball 110.

Additionally, in the embodiment exemplified in FIG. 6A, the bottom rim 48 of the lower tilt section 98 of the tilt mechanism 88*a* can serve as a hammer 48 for impacting the anvil of a standard. In the embodiment exemplified, the tilt mechanism 88*a* is fixed or integrated at its shoulder 90 to the tubular sleeve 20 by means of a weld 91. The lower tilt section 98 of the tilt mechanism 88*a* extends into and is closely received by the interior of the tubular sleeve 20. Although the illustrated means of integrating a tilt mechanism 88 to a tubular sleeve 20 is a weld, other means of integration are known to the ordinary skilled artisan and practicable in the present invention. For example, the detent pin 74 and through hole 76 combination of FIG. 5B can be used to releaseably integrate or fix a tilt mechanism 88 to a tubular sleeve 20. The tilt mechanism 88*a* in combination with the tubular sleeve 20 may be used as described above to drive a pole standard 50 into the ground surface. This embodiment has the advantage when the tilt mechanism 88 is releaseably fixable to the tubular sleeve 20 to provide a less complex tubular sleeve 20, and the option to include a tilt mechanism 88 on the anchored umbrella pole 14 if desired by the user.

Figure 9C:
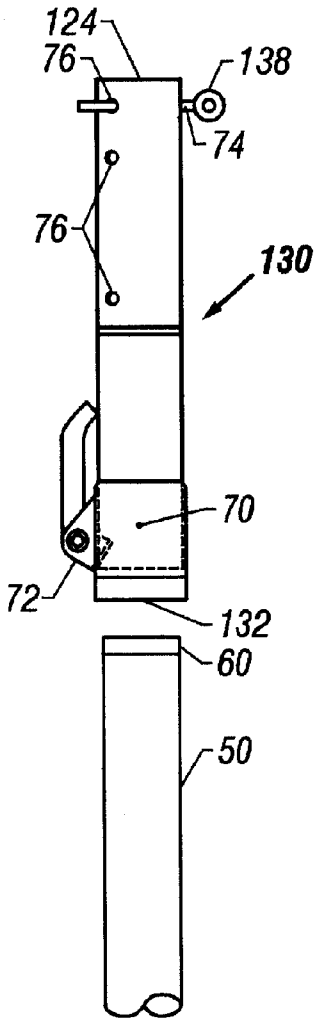
Figure 9B:
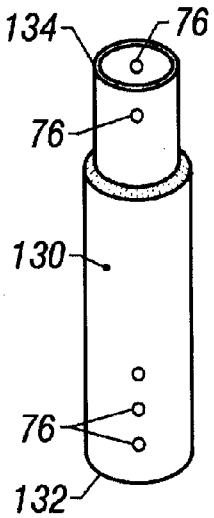
FIGS. 9A & 9B are perspective views of two similar embodiments of an insert section of the present invention.
Figure 9A:
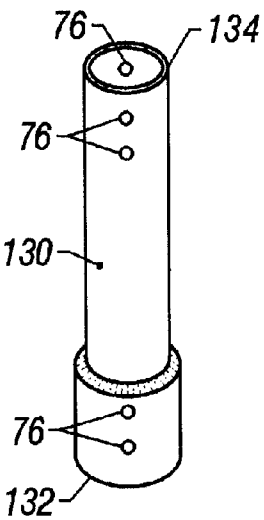

In another preferred embodiment as exemplified in FIGS. 9A to 9C, the present device 10 includes one or more extension sections 130 that can be inserted into the umbrella pole 14 in series between the standard 50 and the tubular sleeve 20 to adjust the length of the pole 14. An extension section 130 has a lower end 132 similar to the second of lower end 24 of the tubular sleeve 20 in that it is configured to closely receive a standard 50 into an interior space or lumen (not shown). Also, the upper end 134 of the extension section 130 is similar to the upper end 52 of a pole standard, in that it can be received into the lumen 26 of a tubular sleeve.

It is also intended in the present device 10 that, the user can dismount the umbrella canopy 12 from the umbrella pole 14 and use the pole 14 for other related purposes. For example, with the canopy removed, the umbrella pole 14 can be used as a tether ball pole (see FIG. 9C) or a flag pole on which a pennant may be displayed so that the user's location may be more easily found on a crowded beach. The latter is an important benefit when at the beach with children. Alternatively, two umbrella poles 14, sans a canopy 12, may be used to mount a net between them, such as for volley ball or badminton. Means for attaching a net or flag to the umbrella pole 14 are known in the art and are readily adaptable by the ordinary skilled artisan for practice in the present invention. FIG. 9C illustrates an example of such flag or net attachment means as a detent pin 74 with an eye 138 integral to it. To accomplish the net or flag attachment, the number of detent pins 74 desired are inserted into the appropriate through holes 76 at the upper end of the umbrella pole 14. The length of the pole 14, and thus the height of the flag or net (not shown) above the ground surface can be adjusted as described above.

Figure 7B:
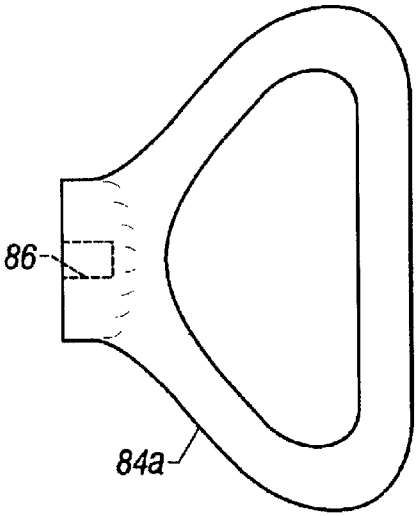
FIGS. 7A and 7B are side views of handles that may be used with the present umbrella.
Figure 7A:
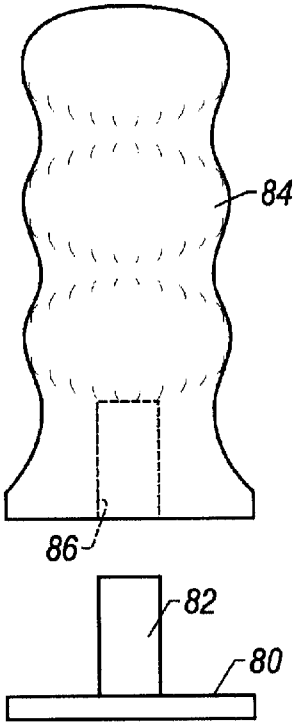

Umbrella canopies practicable in the present invention, and means for raising and folding them are known in the art. Such canopies and raising and folding means for umbrella canopies are known to and readily adaptable by the ordinary skilled artisan to the present invention. It is not intended that the present invention claim any specific umbrella canopy. However, as practiced in an alternative embodiment, the present umbrella canopy 12 includes a handle 84 attached to the top end 80 of the canopy 12. The handle may be attached to the top end 80 by any of a variety of means known to the ordinary skilled artisan. For example, as shown in FIG. 7A, a post hole 86 disposed in the handle receives the attachment post 82 on the canopy top end 80. The attachment post 82 may be glued inside the hole 86 or may be threaded and screwed into the post hole 86, in order to attach the handle 84 to the canopy top end 80. FIG. 7B, shows an alternative embodiment of a handle 84*a*.

The present invention may be constructed of its elemental parts and provided as separate components assemblable by the user. For example, the canopy 12, the tubular sleeve 20 including a hammer element, the standard 50 including an anvil element, a tilt mechanism 88 and extension sections 130 may all be provided as separate components and contained in a kit to facilitate transport and storage of the present umbrella 10. The kit may contain various of the components of the present invention and any ancillary hardware, such as attachment means (e.g., eye-fasteners) for flags, lines, nets and the like.

Figure 8:
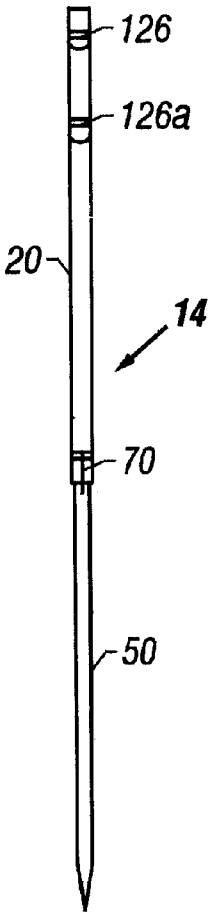
FIG. 8 is a side view of a self-anchoring pole of the present invention adapted as a net pole.

Additionally, the present invention without the umbrella canopy is readily adaptable as a self-anchoring pole for use in other applications, such as a tether ball pole, or a pole for mounting a net in badminton and volley ball type games. See FIG. 8. The present pole 14 may be adapted with net mounts 126, one of which may be a sliding adjustable net mount 126*a* for mounting nets (not shown) of different widths to the pole 14. Preferably, the pole 14 includes a slide lock 70 for adjusting the height of the net from the ground.

The present invention, therefore, is well adapted to carry out the objects and attain the ends and advantages mentioned, as well as others inherent therein. While presently preferred embodiments of the invention have been given for purposes of disclosure, numerous changes in the details of procedures for accomplishing the desired results will readily suggest themselves to those skilled in the art, and such changes are encompassed within the spirit of the present invention disclosed herein and the scope of the appended claims.

What is claimed is:

1. A self-anchoring beach umbrella comprising an umbrella canopy and an umbrella pole, the umbrella pole further comprising:

an upper member for supporting the canopy and a lower member for self-anchoring the umbrella into a ground surface;

the upper member being an elongated tubular sleeve having a first end communicating with and supporting the umbrella canopy, the first end further comprising tilt mechanism, disposed between the upper member tubular sleeve and the canopy, an axial lumen formed within the elongated tubular sleeve, and a second end for receiving a pole standard into the axial lumen;

the lower member being a pole standard having a length, a first end formed for insertion into the axial lumen of the elongated tubular sleeve, and a second end formed for anchoring into the ground surface;

a hammer fixed to the elongated tubular sleeve, the hammer for transmitting an axial force applied to the elongated tubular sleeve onto an anvil; and an anvil fixed to the pole standard for receiving the axial force from the hammer and transmitting it to the pole standard to anchor the pole standard into the ground surface.

2. The self-anchoring beach umbrella of claim 1 wherein the umbrella pole further comprises a tubular sleeve having an axial lumen formed inside of the tubular sleeve to coaxially and slideably receive a pole standard.

3. The self-anchoring beach umbrella of claim 1 wherein the umbrella pole further comprises the hammer and the anvil capable of transmitting and receiving a downward axial force of sufficient magnitude to anchor the pole standard into the ground surface.

4. The self-anchoring beach umbrella of claim 1, wherein the umbrella pole further comprises the hammer being inside the tubular sleeve and fixed to a wall of the lumen at a position distal from the second end of the sleeve; and the anvil fixed at the first end of the pole standard, the anvil for receiving an impact from the hammer when the pole standard is slideably received into the lumen of the tubular sleeve and the tubular sleeve is slid down the length of the pole standard.

5. The self-anchoring beach umbrella of claim 1, wherein the umbrella pole further comprises the hammer fixed proximate the second end of the tubular sleeve and disposed to allow insertion of the first end of the pole standard into the lumen of the tubular sleeve and the anvil being a collar fixed on an outer surface of the pole standard distal from the first end of the pole standard, and disposed to receive the downward axial force from the hammer.

6. The tilt mechanism of claim 1, wherein the tilt mechanism is removably disposed between the upper member tubular sleeve and the canopy.

7. The tilt mechanism of claim 6, wherein the tilt mechanism is disposed between the upper member tubular sleeve and the canopy, and is removable from the canopy, and is fixed to the tubular sleeve and disposed to serve as the hammer.

8. The tilt mechanism of claim 6, wherein the tilt mechanism is disposed between the upper member tubular sleeve and the canopy, and is removable from the canopy, and is removeably fixed to the tubular sleeve.

9. The self-anchoring beach umbrella of claim 1, wherein the umbrella pole further comprises at least one extension section for insertion into the pole between the upper member and the lower member, the extension for adjusting the length of the umbrella pole.

10. The self-anchoring beach umbrella of claim 1, wherein the upper member further comprises its second end having a slide lock for adjusting a length of the umbrella pole by fixing the position of the upper member relative to the lower member.

11. The self-anchoring beach umbrella of claim 1, wherein the umbrella pole further comprises the upper member having attachment means proximate the first end.

12. The self-anchoring beach umbrella of claim 11, wherein the umbrella pole further comprises the upper member having a detent pin with a attachment eye proximate the first end.

13. The self-anchoring beach umbrella of claim 1, wherein the umbrella pole further comprises a handle attached to the upper end.

14. A method of anchoring the umbrella pole of the self-anchoring umbrella of claim 1 into a ground surface comprising the steps of:

positioning the second end of the pole standard to be anchored at the ground surface;

inserting the tubular sleeve coaxially over the pole standard to receive the pole standard into the lumen of the tubular sleeve;

applying a downward axial force on the tubular sleeve to slideably receive the pole standard into the lumen of the tubular sleeve and cause the hammer to impact the anvil;

transmitting a force from an impact of the hammer with the anvil to the pole standard to anchor the pole standard into the ground surface;

reapplying the downward axial force on the tubular sleeve so that the hammer repeatedly impacts upon the anvil until the pole standard is anchored into the ground surface; and leaving the tubular sleeve in place over the pole standard to provide an umbrella pole anchored into the ground surface.

15. A self-anchoring beach umbrella kit comprising:

the umbrella of claim 1;

instructions for assembling and using the umbrella; and a container for holding and transporting the canopy, tubular sleeve, standard and instructions.

16. The self-anchoring beach umbrella kit of claim 15, further comprising at least one additional item selected from the group consisting of: ancillary hardware, a tilt mechanism, and an extension section.

* * * * *